United States Patent [19]

Grossman

[11] 4,210,063

[45] Jul. 1, 1980

[54] FLUID POWER DEVICE

[76] Inventor: William C. Grossman, 4274 Briarwood Way, Palo Alto, Calif. 94303

[21] Appl. No.: 2,428

[22] Filed: Jan. 10, 1979

[51] Int. Cl.[2] ..... F01B 15/00

[52] U.S. Cl. ..... 91/196; 60/369; 74/57

[58] Field of Search ..... 91/61, 196, 218, 303, 91/315, 401; 74/11, 57, 129; 60/369; 92/31

[56] References Cited

U.S. PATENT DOCUMENTS

| | | | |
|---|---|---|---|
| 1,773,366 | 8/1930 | Lear | 91/315 X |
| 2,261,444 | 11/1941 | Neubert | 91/401 X |
| 3,090,244 | 5/1963 | Davis | 92/31 X |
| 3,388,548 | 6/1968 | Vieths | 60/369 |

*Primary Examiner*—Edgar W. Geoghegan
*Attorney, Agent, or Firm*—John L. McGannon

[57] ABSTRACT

A fluid actuated power device which includes a reciprocal cylinder rotatably mounted on a central, tubular shaft for back-and-forth movement along the shaft between a pair of end support members. The cylinder has first and second sets of spiral grooves on its outer surface, the first set of spiral grooves being in mesh with the spiral teeth of a first ratchet gear and the second set of spiral grooves being in mesh with the spiral teeth of a second ratchet gear, the ratchet gears being carried by a cylindrical body fixed relative to the shaft. The ratchet gears permit the cylinder to rotate only in one direction relative to and about the shaft as the cylinder moves back and forth along the length of the shaft. The cylinder is coupled by spline means to a gear assembly which, in turn, is connected to a rotatable second shaft, the latter serving as a power takeoff means which can be connected to external work-producing apparatus. A piston within the cylinder and rigid to the central part of the first-mentioned shaft allows a fluid under pressure to be alternately applied to the two chambers of the cylinder on opposite sides of the piston to thereby cause the back and forth movement of the cylinder relative to the shaft. A 4-way valve communicates with the opposite ends of the shaft to sequentially connect the chambers to a fluid pressure source and to the atmosphere.

10 Claims, 7 Drawing Figures

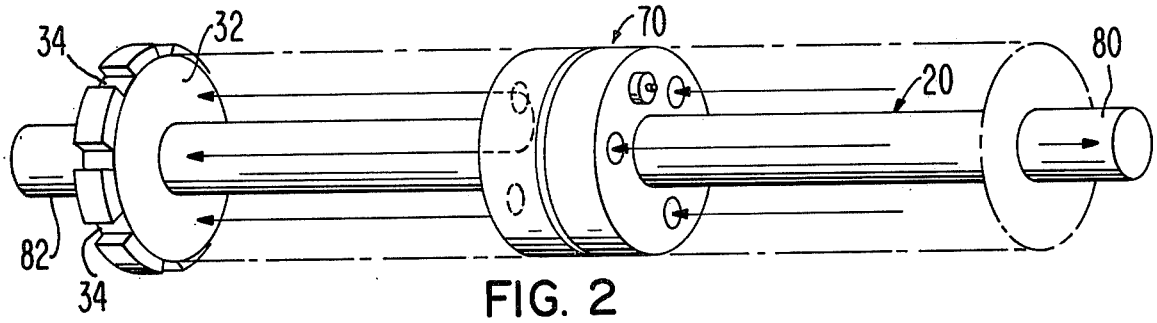
FIG. 2
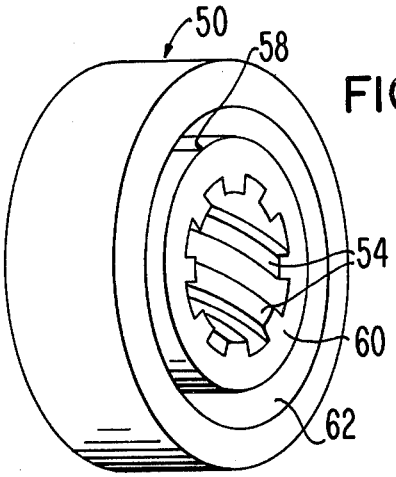
FIG. 3
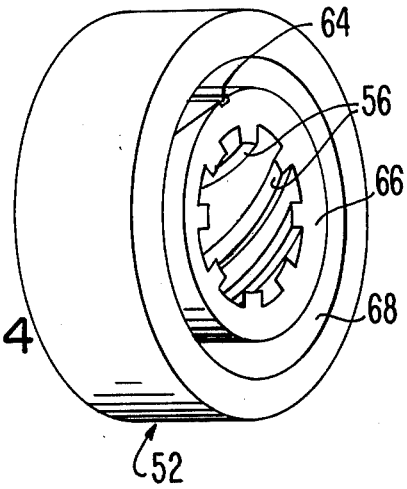
FIG. 4
FIG. 5
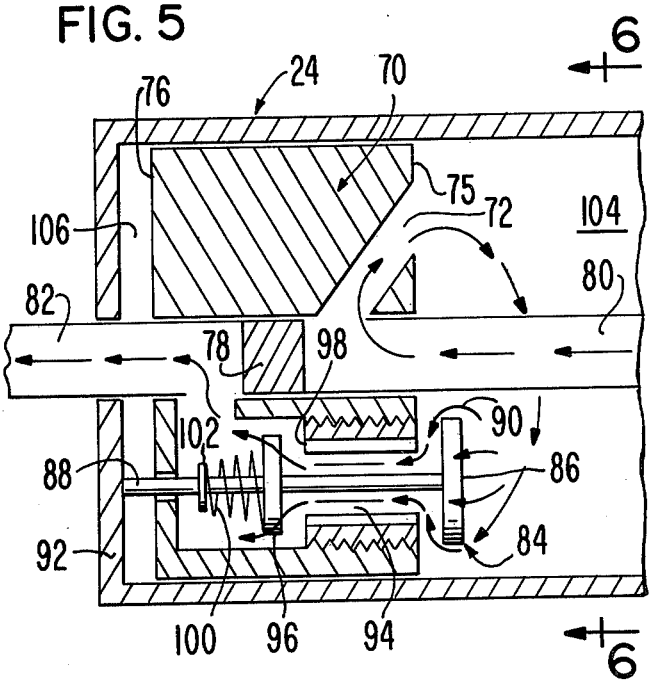
FIG. 6
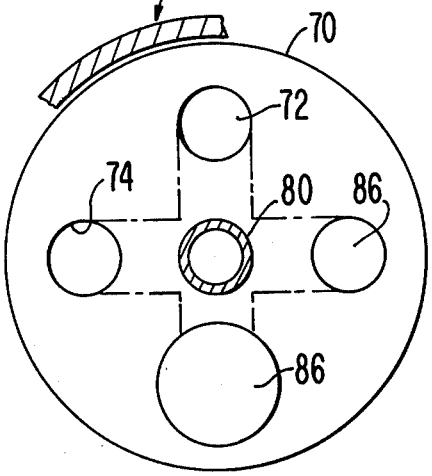

FLUID POWER DEVICE

This invention relates to improvements in power actuated devices and, more particularly, to a fluid actuated power device which operates to convert the back and forth motion of a cylinder to rotational motion.

BACKGROUND OF THE INVENTION

It is becoming increasingly important for the power industry to realize that it must produce more energy output with fewer resources. Maximizing the efficiency of power devices has become a prime consideration with respect to the conservation of energy. In many cases, fluid power systems are more efficient than electrical power systems and fluid actuated power devices themselves, because of their specific designs, contribute to this efficiency.

For instance, fluid motors offer greater advantages over electrical motors, such as better power-to-weight ratios, reversing capability and ability to stall without damage under extreme loads. Fluid motors can also operate in hazardous environments without risk of explosion, a feature not achievable by unprotected electrically actuated motors. Rather than using a bulky and generally more expensive high speed electrical motor with a speed reducer to produce high torque at low speeds, a low speed, high torque fluid power device offers similar and sometimes superior performance in a single package at lower cost. For these reasons, the need for continually providing improvements in fluid power devices remains a significant challenge to the power industry so that more work can eventually be performed at lower energy expenditures.

SUMMARY OF THE INVENTION

The present invention contributes to the satisfaction of the aforesaid need by providing an efficient fluid actuated power device which is simple and rugged in construction and operates to efficiently convert reciprocal movement of a driven member into rotational motion which can be used to drive a work-producing apparatus. To this end, the present invention provides a fluid actuated power device which includes a cylinder mounted for reciprocation on a tubular central shaft with the cylinder having two sets of spiral grooves on its outer surface, one set of grooves extending about the surface in one rotative sense and the other set of grooves extending about the surface in the opposite rotative sense. A pair of ratchet gears carried by a fixed support on the power device have spiral teeth which mesh with respective sets of spiral grooves on the outer surface of the reciprocal cylinder to assure that the cylinder rotates only in one direction around the central shaft as the cylinder moves back and forth along the length of the shaft.

The cylinder is coupled by spline means to a gear assembly so that, as the cylinder moves back and forth and rotates relative to the central shaft, the gear assembly is rotated to, in turn, cause rotation of a drive shaft from which power can be taken to operate a work-producing apparatus.

The central shaft has a centrally disposed dual actuating piston thereon, the piston being within the cylinder and operating to alternately connect a fluid pressure source with the two chambers of the cylinder on opposite sides of the piston. As one chamber is pressurized, the other chamber is vented to the atmosphere and the cylinder is caused to move in one direction along the length of the shaft. Similarly, when the other chamber is pressurized, the first chamber is exhausted to the atmosphere and the cylinder moves in the opposite direction along the central shaft. This action continues to in turn cause continuous rotation of the gear assembly and drive shaft so that the power device can perform work in a highly efficient manner.

The primary object of this invention is, therefore, to provide an improved fluid actuated power device which is simple and rugged in construction, is made of relatively few parts, and can be quickly assembled, yet the device offers high efficiency and reliability through a wide range of operating characteristics.

Another object of the present invention is to provide a fluid actuated power device of the type described wherein the reciprocal movement of a cylindrical member is efficiently converted to rotational motion without the need for a complex fluid drive system and without sacrificing the relatively high efficiency of operation.

Other objects of this invention will become apparent as the following specification progresses, reference being had to the accompanying drawings for an illustration of the invention.

IN THE DRAWINGS:

FIG. 2 is a perspective view of the floating spiral cylinder forming part of the motor;

FIGS. 3 and 4 are perspective views of ratchet gears forming parts of the motor and in mesh with the spiral grooves on the outer surface of the floating cylinder;

FIG. 5 is an enlarged, fragmentary, cross-sectional view of a dual piston assembly forming part of the motor; and FIG. 6 is a cross-sectional view taken along line 6—6 of FIG. 5.

Figures 1, 1A:
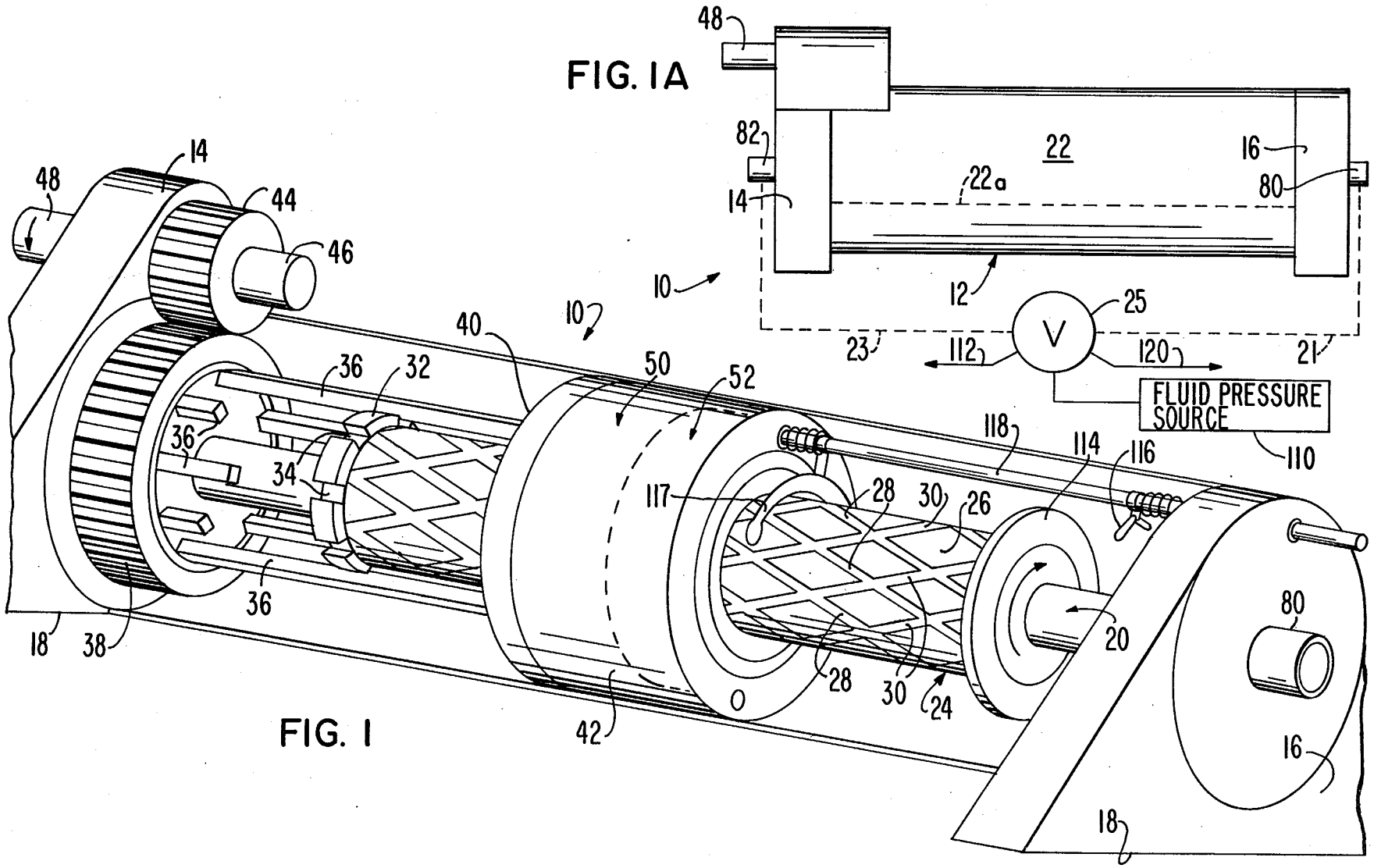
FIG. 1 is a perspective view of the floating spiral cylinder motor of this invention with its outer cover removed.
FIG. 1A is a side elevational view of the motor.

The floating spiral cylinder motor of this invention is broadly denoted by the numeral 10 and includes a housing 12 which is tubular and provided with a pair of end support members 14 and 16 which, as shown in FIG. 1, are generally triangular in shape to present flat bottom surfaces 18 so that motor 10 can rest on or be secured to a supporting surface (not shown). Motor 10 includes a tubular shaft 20 which spans the distance between and extends through end members 14 and 16, shaft 20 being spaced above surfaces 18 of end members 14 and 16 and being open at its opposed ends so that it can communicate by fluid lines 21 and 23 (FIG. 1A) with a 4-way valve 25. A tubular cover 22 (FIG. 1A) also spans the distance between and is connected to end members 14 and 16, cover 22 surrounding shaft 20 and being spaced outwardly therefrom.

A floating cylinder 24 (FIGS. 1 and 2) is rotatably mounted on the shaft 20 and is shiftable axially thereof. Cylinder 24 has a cylindrical outer surface 26 provided with two sets of spiral grooves. One set has spiral grooves 28 extending in one rotative sense about surface 26 and a second set has spiral grooves 30 extending about surface 26 in the opposite rotative sense. Grooves 28 and 30 extend throughout substantially the length of cylinder 24. Cylinder 24 is tubular and has a first end member 32 (FIGS. 1 and 2) provided with spaced, outer peripheral notches 34 which are in sliding engagement with and receive respective splines 36 which are secured at first ends thereof to a spur gear 38 rotatably mounted by bearing means (not shown) on shaft 20 near end member 14 (FIG. 1). The opposite ends (not shown) of splines 36 are secured to a ring 40 rotatably mounted by bearing means (not shown) on a cylindrical tubular body 42 which is stationary between end members 14 and 16 and generally midway therebetween. Spur gear 38 is in mesh with a smaller spur gear 44 rigid to a shaft 46 rotatably mounted by bearing means (not shown) on the upper extremity of end member 14, the outer end 48 of shaft 46 being the power takeoff means by which energy from motor 10 can be transferred to external, work-producing apparatus (not shown).

Body 42 has two ratchet gears 50 and 52 (FIGS. 3 and 4) mounted therein, ratchet gear 50 having spiral teeth 54 in mesh with and received within respective spiral grooves 30 of cylinder 24 and gear 52 having spiral teeth 56 in mesh with and received within respective spiral grooves 28 of cylinder 24. Each of these two gears has an inner race provided with the spiral teeth on its inner periphery and an outer race in which the inner race is rotatably mounted. Gear 50 also has at least one ratchet device 58 which allows the inner race 60 of gear 50 to rotate only in one direction relative to the outer race 62 thereof. Similarly, gear 52 has at least one ratchet device 64 allowing the inner race 66 of gear 52 to rotate relative to the outer race 68 also only in one direction, namely in a direction opposite to the direction in which inner race 60 of gear 50 is permitted to rotate.

Cylinder 24 has a dual acting piston 70 rigid to the central part of shaft 20 and having two fluid exit ports 72 and 74 on opposed faces 75 and 76, respectively thereof, only port 72 being shown on face 75 in FIG. 5, the other port 74 not being shown in FIG. 5 but being shown in dashed lines in FIG. 6. Cylinder 24 surrounds piston 70 as shown in FIG. 5 and shifts back and forth relative to the piston. Each of the ports 72 and 74 is in fluid communication with a respective part of shaft 20, there being a plug 78 (FIG. 5) separating the two shaft parts 80 and 82, respectively. Port 72 communicates with shaft part 80 and port 74 communicating with shaft part 82.

A safety valve 84 is provided for each of faces 75 and 76, respectively of piston 70. Each safety valve 84 includes a valve member 86 having a valve stem 88 and a valve seat 90 which is normally engaged by valve member 86 to close the valve 84. Valve stem 88 is shiftably mounted on bearings (not shown) and, for valve 84 of face 75 shown in FIG. 5, is caused to move to the right when viewing FIG. 5 when an end wall 92 of cylinder 24 moves too close to piston 70, (such as in an emergency situation when the fluid pressure is higher than normal or if either end of cylinder 24 exceeds maximum design travel). This causes valve member 86 to move away from valve seat 90 as shown in FIG. 5 and allow fluid to move as shown by the arrows into and through passage 94 to unseat a check value 96 from a valve seat 98 against the bias force of a coil spring 100 surrounding stem 88 and extending between check valve 96 and a stop 102 rigid to stem 88. Valve 96 is not rigid to and is slidable on stem 88. This allows pressurized fluid adjacent to face 74 of piston 70 to be exhausted to the opposite end part 82 of shaft 20 and to the atmosphere through 4-way valve 25 until the emergency situation has been eliminated.

Fluid under pressure entering shaft part 80 will flow into chamber 104 adjacent to face 75 of piston 70 (FIG. 5) to move cylinder 24 to the right relative to piston 70. Similarly, fluid under pressure moving into and through shaft part 82 will pass through port 74 and into chamber 106 adjacent to face 76 to cause cylinder 24 to move to the left when viewing FIG. 5.

In operation, 4-way valve 25 is coupled to a source 110 of fluid under pressure, such as air under pressure. Valve 25 is also coupled to the outer ends of shaft parts 80 and 82 by lines 21 and 23 so as to permit fluid to enter and leave the shaft parts sequentially to drive the cylinder 24 back and forth and thereby rotate gear 38 continuously in one direction and turn the drive shaft 48 continuously in a direction opposite to the direction of rotation of gear 38.

To commence the operation, fluid enters valve 25 from fluid source 110 and enters shaft part 80 where the fluid then passes into chamber 104 through port 72 causing cylinder 24 to move from left to right when viewing FIG. 5. When this occurs, fluid is evacuated from chamber 106 and passes out of the same through the corresponding port 74, through shaft part 82, and through valve 25 to an exhaust line 112. Simultaneously with the movement of cylinder 24 to the right when viewing FIG. 5, cylinder 24 will rotate in a clockwise sense when viewing FIG. 1 since its first set of grooves 28 are in mesh with the teeth 54 of gear 50 and the teeth 54 are stationary due to ratchet 58 of gear 50 preventing rotation of the corresponding inner race 60 relative to shaft 20 and body 42. However, ratchet 64 of gear 52 allows free wheeling of inner race 66 of gear 52 so that this inner race 66 rotates with cylinder 24 during this time.

Cylinder 24 will continue to move to the right or toward end member 16 until an end disk 114 (FIG. 1) on cylinder 24 strikes a stop arm 116 rigidly carried on a rod 118 extending between end member 16 and body 42. When this occurs, rod 118 is caused to move to the right when viewing FIG. 1 and, because the rod is coupled to valve 25, it operates the valve to close the communication between line 21 and source 110 and to open the communication between line 21 and an exhaust line 120. At the same time, source 110 is placed in fluid communication with chamber 106 through line 23, shaft part 82 and port 74. When this occurs, fluid under pressure enters chamber 106, causing cylinder 24 to move to the left when viewing FIG. 5.

As cylinder 24 moves to the left, its spiral grooves 30 are in mesh with teeth 56 of gear 52, tending to rotate the inner race 66 of gear 52 in a counterclockwise sense. However, ratchet 64 of gear 52 prevents this action so that, as cylinder 24 moves to the left, the cylinder will continue to rotate in a clockwise sense when viewing FIG. 1. Ratchet 64 of gear 50, however, allows free wheeling of inner race 60 of gear 50 so that this inner race 60 rotates with cylinder 24 relative to shaft 20 during this time. Typically there will be more ratchets than a single ratchet in each of gears 50 and 52; however, only one has been shown in each gear for simplicity.

As cylinder 24 approaches the left-hand end of its path of travel, disk 114 engages an arm 117 rigid to rod 118 and causes the rod to shift to the left, thereby operating valve 25 in a manner opposite to that when disk 114 engages and moves arm 116. When this occurs, fluid flow to chamber 106 is shut off and fluid flow to chamber 104 is again commenced. In this way, cylinder 24 is caused to move continuously back and forth relative to shaft 20.

As cylinder 24 rotates in a clockwise sense in viewing FIG. 1, it continuously rotates spur gear 38 in a clockwise sense. This causes counterclockwise rotation of gear 44 and thereby shaft 46 and power can be taken off the end 48 of shaft 46 and transferred to work-producing apparatus.

In view of the foregoing, it is clear that motor 10 provides a means to convert the linear back-and-forth motion of cylinder 24 to continuous rotation of shaft 48 in one direction regardless of the direction of travel of cylinder 24. Valve 25 can be of any conventional construction and can be either air operated or solenoid operated. A typical solenoid-operated valve suitable for this purpose is one made by the Aro Corporation, Bryan, Ohio 43506 and identified as Series 52 4-way Poppet Valve.

Oil can be used in housing 22 for lubricating the moving parts and friction surfaces of the system. The oil can be at a level 22a as shown in FIG. 1A.

I claim:

1. A fluid actuated power device comprising: a tubular shaft; a tubular cylinder shiftably mounted on the shaft for reciprocation along the length thereof; means coupled with the shaft and the cylinder for dividing the cylinder into two chambers which vary in volume as a function of the movement of the cylinder relative to the shaft; means coupled with the cylinder for rotating the same only in one direction about the shaft as the cylinder reciprocates relative thereto; means coupled with the shaft for admitting a fluid under pressure alternately into the chambers to cause the cylinder to reciprocate relative to the shaft; and means coupled with the cylinder for converting the reciprocal motion of the cylinder to rotational motion.

2. A power device as set forth in claim 1, wherein the cylinder has two sets of spiral grooves in the outer surface thereof, one set of grooves extending about the cylinder in one rotative sense and the other set of grooves extending about the cylinder in the opposite rotative sense, said cylinder rotating means including a ratchet gear for each set of spiral grooves, respectively.

3. A power device as set forth in claim 2, wherein each ratchet gear includes an inner race and an outer race, the inner race being rotatable in the outer race and having spiral teeth on the inner periphery thereof, the spiral teeth being received within the spiral grooves of a respective set, there being a ratchet for each ratchet gear, respectively, each ratchet being operable to interlock the corresponding inner and outer races as a function of the movement of the cylinder in a respective direction along the shaft.

4. A power device as set forth in claim 2, wherein is provided a cylindrical body fixed relative to the shaft, the ratchet gears being carried by the body in surrounding relationship to the shaft and the cylinder.

5. A power device as set forth in claim 4, wherein the connecting means includes a gear assembly, said body having a ring rotatably mounted at one end thereof, and including spline means coupled with the ring and the cylinder for rotating the gear assembly in said one direction as a function of the reciprocation of the cylinder relative to the shaft.

6. A power device as set forth in claim 1, wherein said shaft has a central plug therein to define two shaft parts out of fluid communication with each other, said admitting means includes a piston rigidly secured to the shaft within the cylinder, the piston having a first fluid passage placing one chamber of the cylinder in fluid communication with a first part of the shaft and a second passage placing the other chamber of the cylinder in fluid communication with a second part of the shaft, the ends of the shafts adapted to be coupled to a source of fluid under pressure.

7. A power device as set forth in claim 6, wherein the piston has a safety valve for each chamber, respectively, each safety valve being operable to vent the corresponding chamber to the shaft part corresponding to the other chamber as a function of the position of the cylinder relative to the shaft.

8. A power device as set forth in claim 6, wherein as included a valve means having a pair of fluid outlets coupled to respective ends of the shaft, the valve means being operable to couple a source of fluid under pressure to alternate the ends of the shaft.

9. A power device as set forth in claim 8, wherein said admitting means includes a rod shiftable longitudinally of the shaft, the cylinder having a projection thereon for engaging the rod as the cylinder approaches each end, respectively, of its path of travel relative to the shaft, the rod being coupled to the valve means for operating the same and reversing the connection of the valve means with the chambers as the cylinder reaches the opposed ends of its path of travel.

10. A power device as set forth in claim 1, wherein said converting means includes a gear assembly, spline means secured to the gear assembly and slidably coupled with the cylinder to cause rotation of the gear means as a function of the reciprocation of the cylinder relative to the shaft, and a power takeoff shaft coupled with the gear assembly for connection to work-producing apparatus.

* * * * *